US007591297B2

(12) United States Patent
Lee

(10) Patent No.: US 7,591,297 B2
(45) Date of Patent: Sep. 22, 2009

(54) WINDOW BLINDS WITH ALTERNATE LIFT MECHANISM

(76) Inventor: Han-Sen Lee, 98-1, Show-Tsuo St. Show-Tsuo Village, Fu-Hsing Hsiang, Chang-Hwa Hsien (TW)

( * ) Notice: Subject to any disclaimer, the term of this patent is extended or adjusted under 35 U.S.C. 154(b) by 60 days.

(21) Appl. No.: 11/529,970

(22) Filed: Sep. 29, 2006

(65) Prior Publication Data

US 2008/0078510 A1 Apr. 3, 2008

(51) Int. Cl.
*E06B 9/30* (2006.01)

(52) U.S. Cl. ..... 160/168.1 R; 160/176.1 R

(58) Field of Classification Search ..... 160/168.1 R, 160/176.1 R, 113, 115, 116, 178.3
See application file for complete search history.

(56) References Cited

U.S. PATENT DOCUMENTS 6,305,454 B1 * 10/2001 Judkins et al. ..... 160/115
6,318,439 B1 * 11/2001 Matsubara ..... 160/115
6,405,783 B1 * 6/2002 Smith ..... 160/176.1 R
6,648,048 B2 * 11/2003 Lai ..... 160/115
7,178,576 B2 * 2/2007 Nien et al. ..... 160/168.1 R

* cited by examiner

*Primary Examiner*—Katherine W Mitchell
*Assistant Examiner*—Candace L. Bradford
(74) *Attorney, Agent, or Firm*—Curtis L. Harrington; Kathy E. Harrington; Harrington & Harrington

(57) ABSTRACT

In a first embodiment, a selective adjustment cord is provided as a very thin cord is extended through a series of thin engagement apertures which lie adjacent the main lift cord openings in a horizontal blind set. A series of engagement structures themselves cannot fit through the thin engagement apertures, and the selective adjustment cord is capable of movement of a louver having an engagement structure by only about the distance between adjacent louvers. In a second embodiment a slip fitting can be placed on specified louvers such that the first amount of upward travel of the lift cord will immediately lift the slats to which the slip fitting is engaged. Further movement of the lift cord will overcome the resistance of the slip fitting and allow the blinds to be lifted normally.

11 Claims, 3 Drawing Sheets

WINDOW BLINDS WITH ALTERNATE LIFT MECHANISM

FIELD OF THE INVENTION

The present invention relates to an improvement in window blinds which enables individuals to have more control over the admission of light and blind orientation with a greatly simplified control.

BACKGROUND OF THE INVENTION

Horizontal blind systems typically have an upper channel made of metal and configured to support movement and bearing components for horizontal blind operation. The two main operations are the elevation of the bottom horizontal which automatically collects the suspended horizontal step connectors above it and clears the window opening, and the angular movement of the slats utilized to allow light into the room at high or low angle or to close the louvers completely.

Where the louvers are left horizontal, very little direct light enters through the window unless the sun or exterior lighting is at low angles. Most louvered blinds are constructed so that the louvered width is sufficient for a small overlap to enable the louvers to be closed in either direction from horizontal to shut out the light. Even assuming no bare overlap, the louvers assume a position at horizontal such that the light source is typically lower than a 45° angle before light is admitted. Given a slight overlap, this angle is typically lower, at about 40° to about 43°.

In the summer, it is desired to open the louvers to a horizontal position to admit cooling breezes. However, this action also provides shade from high angle sun light, even if it is desired to admit the sunlight into the room. This action has the advantage in that the blocking of the breezes are minimized, but light can be admitted only by angling the louvers.

In angling the louvers to let in the sunlight (while still providing some privacy), the user must make the louvers track the angle of the sun. When the angle of the sun is tracked, the louvers are angled to enable sunlight to come in sufficiently, but only if the louvers are sufficiently tracking. The angling of the louvers significantly impedes the breeze and air flow into and out of the window opening.

What is needed is a system which will enable alternate ones of the louvers to move close to each other to provide wider gaps in a horizontal blind set. The movement should ideally be able to occur regardless of whether the slats or louvers are horizontal, or non tilted, as well as when the slats or louvers are tilted. The need to facilitate ease of movement is especially important when tilted as light may be admitted to the room while still providing a partial visual barrier to viewing the inside of the room from outside.

In one reference to Lai, U.S. Pat. No. 6,648,048, a complex arrangement is had using a series of adjacent ladders with each ladder having the number of 1/r where r is the number of ladder rungs. Each adjacent ladder can be raised independently with respect to the other ladders. Raising one adjacent ladder moves 1/r slats upward to the adjacent slat. Raising a second ladder moves another 1/r slats up forming an "r" sized bundle.

However, the expense of providing more than a single ladder is tremendous, particularly where that ladder has to be raisable, even over a slight vertical distance. The problems with multiple ladders involve the fact that each additional ladder can move only a limited amount. Most horizontal blind sets don't make accommodation for raising a ladder at all. A cord which is typically attached to the bottom louver collects all of the louvers where the blind set is to be raised. The ladder on a horizontal blind set is typically only for setting the louver angle.

In Lai, the raising of the second ladder involved lifting two sets of cords per side, regardless of whether or not the cords were joined along the way along the path to the user. Further, some mechanism had to be provided to prevent the user from continuing to lift the ladders which could cause the web strings joining the vertical ladder extents to tear or bind against the head rail. In addition to the complicated second ladder, Lai also uses bendable clips to engage the second ladder to enable the user to select which louvers to lift, which causes the areas near the ladders to become crowded into a mess. The device of Lai is complicated and causes extra wear and bunching and inhibits the ability for the user to lift the slat bundle to a height which would otherwise be available without the additional space occupied by the clips and additional ladders.

What is needed is a system which will enable differential lift of horizontal slats in a horizontal blind system to enable one or more slats to be grouped in order to continue to admit some light over a greater range of sun angles while the slats are horizontal, and to admit some breeze flow through while the slates are tilted.

SUMMARY OF THE INVENTION

In a first embodiment, an adjustment cord is provided as a very thin cord is extended through a series of thin engagement apertures which lie adjacent the main lift cord openings in a horizontal blind set. A series of engagement structures are provided on the thin cord which acts as an adjustment cord which is capable of movement of only about the distance between adjacent louvers. In the first embodiment, the engagement structures themselves cannot fit through the thin engagement apertures such that upward movement of the adjustment cord will cause every other (for example) louver or slat to be engaged and lifted upward to a position close to the adjacent slat. In a variation on this embodiment, it may be provided that structures can be provided on the adjustment cord which can have a small clip added or removed by the user to provide the interference which provides the lift.

In a second embodiment, a special lift cord is eliminated in favor of a slip fitting which can be placed on every other (for example) louver or slat in which the first amount of upward travel of the lift cord will immediately lift the slats to which it is connected. Thus the first short length of lift will cause every other (for example) louver or slat having the fitting to lift its associated louver or slat upward until contact is had with the louver or slat above it. Further movement of the lift cord will overcome the resistance of the slip fitting and allow the blinds to be lifted as per usual. Each slip fitting has only enough friction resistance equivalent to the weight of its portion of the louver or slat to be lifted.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
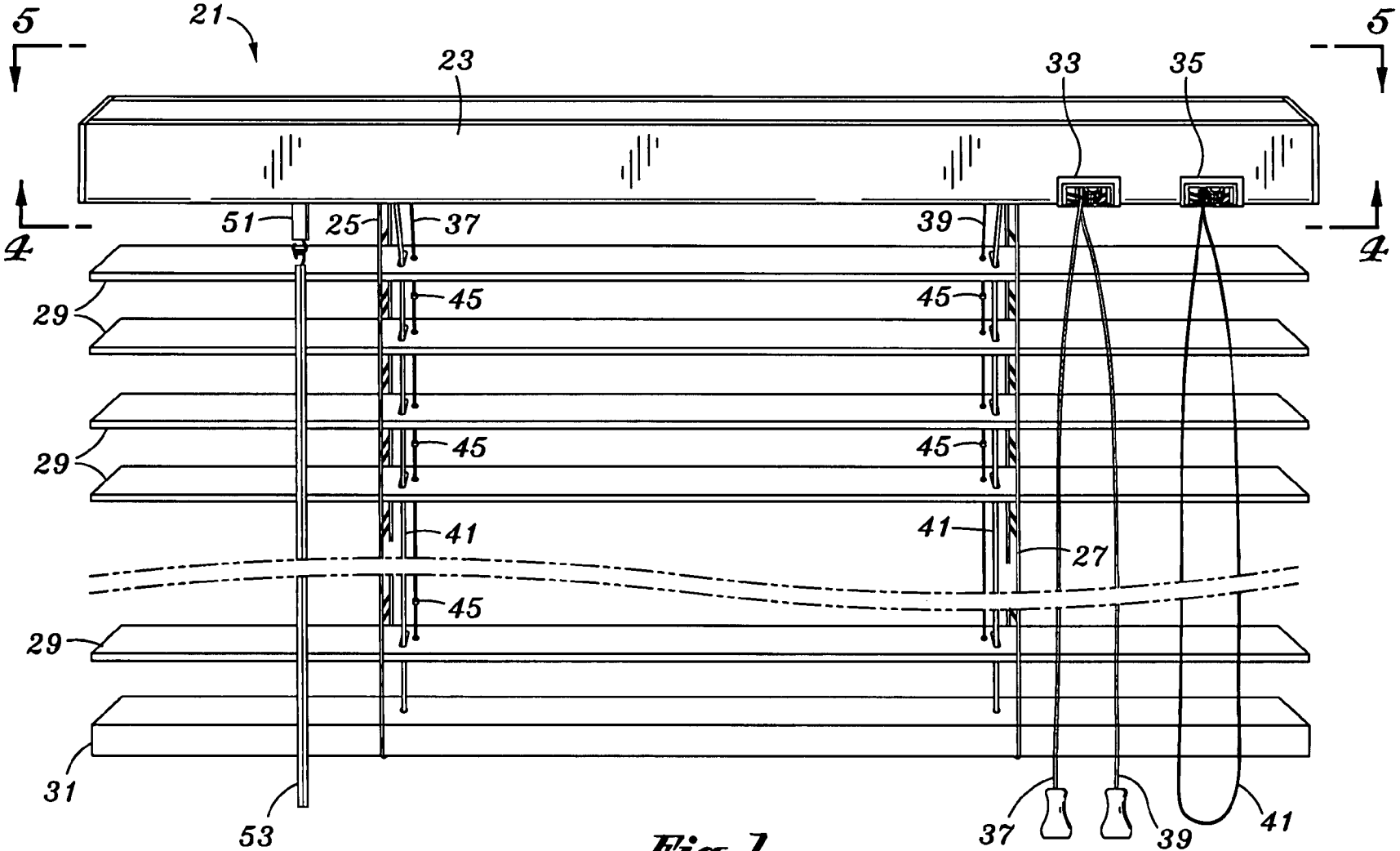
FIG. 1 is a slightly downwardly looking perspective view of a blind set showing a horizontal break line to illustrate that it can be of any overall length and looking down at the head rail and showing two sets of cords, one set operating the louvers for complete lift and the other set of cords extending through a separate hole next to the lift cord and used for manipulating some louvers across a small range of motion from a rest position to a position underneath the next most upper adjacent louver.

The description and operation of the shutter system of the invention will begun to be best described with reference to FIG. 1 which illustrates a first embodiment of a selective lift blind set 21. Selective lift blind set 21 includes a head rail 23 supporting a left ladder cord set 25 and a right ladder cord set 27. As is usual for horizontal blind sets, each ladder cord set 25, 27 has a front and a rear vertical cord and a series of horizontal cords joined between the front and rear vertical cord to form a cradle for a series of slats, or louvers 29 seen in FIG. 1. The lowermost louver is seen as a base louver 31 which is typically thicker and much heavier than the other louvers. Base louver 31 must have sufficient weight to pull the main lift cord through the components of the head rail 21 so that gravity can operate to enable lowering of the louvers 29 of the selective lift blind set 21.

To the right side of the head rail 21 are a pair of locks including a lock 33 and a lock 35. From the lock 33 and through its opening extend a first selective lift cord 37 and a second selective lift cord 39. From lock 35, a looping cord is seen as a lift cord 41. The lift cord 41 is typically the lift cord which has one end attached to one end of the base louver 31 and the other end attached to the end of the base louver 31. The lift cord 41 is typically knotted or attached with a fitting which sets the lift cord 41 together so that one pull on the looping cord 41 will lift the base louver evenly.

In accord with the design approach of the invention, first selective lift cord 37 and second selective lift cord 39 extend through the lock fitting 33, through the head rail 23 and down through a special fitting (not shown in FIG. 1) and emerge as seen on the left side as a continuation of selective lift cord 37 and on the right as selective lift cord 39. The selective lift cords 37 and 39 can be seen as having a series of interference members 45 which are shown in a position not directly underneath the louvers 29 only for the purposes of illustration.

It is understood that the term interference members 45 includes any structures which are capable of physically marking or providing a physical attribute at a place along a cord, in this case first and second selective lift cords 37 and 39. In the embodiment shown, the interference members 45 may be small pieces of metal pressed around the first and second selective lift cords 37 and 39 at specified distances. The manner in which spacing is obtained may vary widely. A cord may be marked to facilitate manual adding of the interference members 45 along its length. The complete selective lift blind set 21 may be laid out with the existing assembly seen in FIG. 1 used to apply the interference members 45 at the time that the selective lift blind set 21 is checked for quality control.

In the position shown, each of the interference members 45 would be resting directly underneath and adjacent every other louver 29 and would not be able to be seen from the angle of FIG. 1. The dropped position of the interference members are for illustration only and merely indicate that the interference members 45 will ideally occur adjacent every other louver 29 in order to lift every other louver 29 upwardly against the louver 29 next most upwardly adjacent. Note also that the selective lift cords 37 and 39 do not extend all the way down to the base louver 31.

The operation of the selective lift blind set 21 will possibly be as follows. Once the lift cord 41 is allowed to travel back through the head rail 23 to enable the louvers to take the position generally shown in FIG. 1. Pulling both of the selective lift cords 37 and 39 will raise every other louver 29 to move the louvers 29 to a position where they are grouped in pairs. As a result the spacing between the collected louver pairs will be doubled.

Because the selective lift cords 37 and 39 lift from the center of each louver, the louvers can be freely tilted from one side to the other. Although many horizontal blind sets may include both cord and wand tilt controls, the selective lift blind set 21 seen in FIG. 1 shows a wand type tilt control, including a tilt fitting 51 to which is attached a wand 53 to facilitate axial turning of the tilt fitting 51. This is typically accomplished by rotating an internal drum to cause the left and right ladder cord sets 25 and 27 to move up and down oppositely. As a front vertical cord of the left and right ladder cord sets 25 and 27 moves up, a rear vertical cord of the left and right ladder cord sets 25 and 27 moves down.

This illustrates a significant advantage over the use of a bulky additional ladder cord to provide the selective lift. Since the lift provided by the method and structure of the present invention occurs at the tilt center of the louvers, they are even more freely tiltable by the conventional ladder cords, and makes the ladder cords work more easily. Each formed double set of louvers in full double set orientation is at least partially supported by the interference members 45.

Further, when the first and second selective lift cords 37 and 39 are actuated partially the louvers partially supported by the interference members 45 will be lifted away from dependence on the left and right ladder cord sets 25 and 27 and will not tend to pivot as much or perhaps even at all, as the other louvers 29 which are directly supported by the left and right ladder cord sets 25 and 27. This would tend to ensure a greater clearance with some visual effects.

When the first and second selective lift cords 37 and 39 are actuated fully, the louvers supported by the interference members 45 will assume an orientation in accord with the position of the louvers on the top of each collected pair. At that point the spacing between the louvers 29 will be double the usual spacing, and sunlight occurring at a steeper angle will be admitted.

Figure 2:
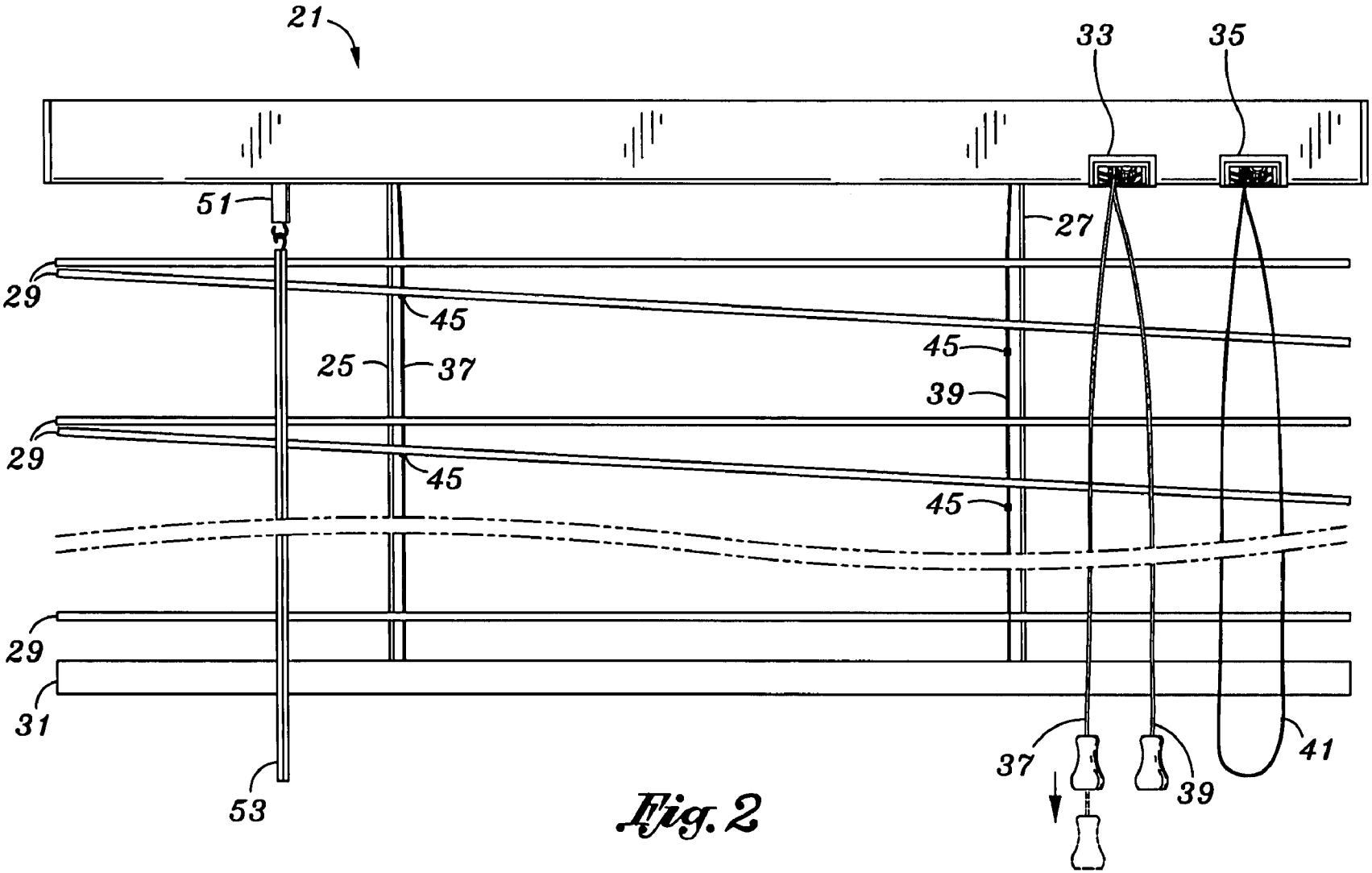
FIG. 2 is a plan view of a series of about four louvers showing the existence of the lift cord and a series of lead crimps which only underlie every other louver, and where only one side is actuated to emphasize the possibility of one-sided actuation and to show that the sides need not be actuated simultaneously.

Referring to FIG. 2, a plan view of the mechanics of the selective lift blind set 21 illustrates partial actuation of only one side of the selective lift blind set 21 namely first selective lift cord 37 while second selective lift cord 39 remains unactuated.

At the left side, the first selective lift cord 37 has been pulled down, causing the left sides of the louvers 29 which lie directly over interference members 45 to be raised up. Of course, the pulling of the first selective lift cord 37 alone typically will not be used to bring pairs of louvers 29 together as a moment is created when the ends of adjacent louvers first meet. This is shown in FIG. 2. FIG. 2 does show the interference members 45 directly under the louver 29 being lifted on the left.

On the right, it can be seen that the louvers 29 being lifted may have been lifted partially upwardly and away from the interference members 45. The first selective lift cord 37 operates in conjunction with the second selective lift cord 39 as they should be lifted simultaneously to effect the even lifting of the louvers 29 overlying the interference members 45 in a manner which will not cause touching of the ends as seen in FIG. 2. However, the ability to actuate one of the first selective lift cord 37 or second selective lift cord 39 independently gives some additional visual variation as is seen in FIG. 2. Thus a gradient is established with the louvers 29 having a separation on the left side as if they were fully paired, while the louvers are more evenly spaced toward the right side of the selective lift blind set 21.

Other alternatives can include a resting position where each lifted louver is moved half way toward the next upper louver, creating a visual impression of un-evenness. The use of the lock 33 enables almost any combination to be achieved and held. Further, the lifting of the louvers 29 does not interfere with the actuation of the tilt fitting 51 and wand 53. Any angle can be achieved by the louvers regardless of angle.

All of the orientations seen in FIGS. 1 and 2 were variations on non-tilted louver 29 positions. Where the louvers 29 are tilted, either forward or rearward, the visual combinations are greatly enhanced. The complete pairing of the louvers will be somewhat offset when tilted, perhaps a one quarter inch overlap or the like. In the tilted position, the partial upward movement of the louvers 29 overlying the interference members 45 can create a dramatic effect. Further, where the louvers 29 have different colors or patterns, the manipulation of the first and second selective lift cords 37 and 39, in combination with the tilt fitting 51 can make dramatic effects.

Figures 3, 4, 5, 6, 7, 8, 9:
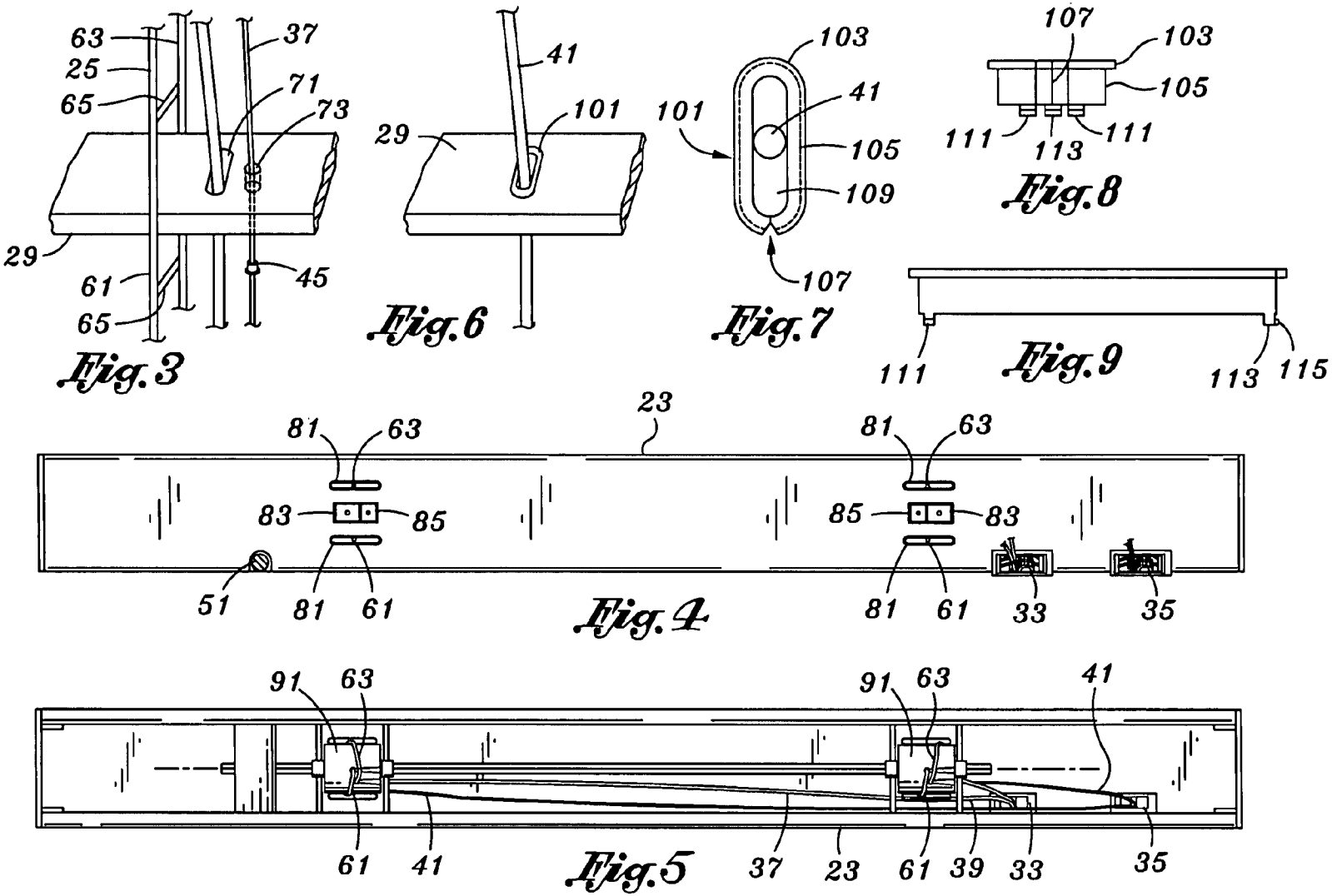
FIG. 3 is a small figure showing details of an interference members which may be a knot, crimp or other vertical distance supporting structure.
FIG. 4 is a view of the bottom of the head rail showing that the main lift cord and alternate lift cord can occupy closely adjacent wear structures.
FIG. 5 is a top view of the head rail seen in FIG. 4 and illustrating the tilt drums and the path of the cord sets seen in FIGS. 1 and 2.
FIG. 6 is a perspective view illustrating the use of a slip fitting mounted on a louver which can provide slight friction based force for lifting a louver having the slip fitting when the lift cord is moved over a vertical distance less than the louver spacing.
FIG. 7 is an expanded and isolated top view of the slip fitting seen in FIG. 6.
FIG. 8 is a still further expanded end side view of the slip fitting seen in FIGS. 6 and 7.
FIG. 9 is a lateral side view of the slip fitting seen in FIGS. 6-8.

Referring to FIG. 3, a closeup view isolated on the left side of one of the louvers 29 seen in FIG. 1 illustrates the relationship of the left ladder cord set 25, lift cord 41 and first selective lift cord 37. The left ladder cord set 25 is seen as having a first vertical cord 61, second vertical cord 63 and which are connected at various levels by horizontal step connectors 65. In the view shown, and for illustration purposes only, the louver 29 is lifted slightly from its resting position in which it would lie atop the horizontal step connector 65 beneath it, as well as upon the interference member 45. If the louver 29 were left in a resting position, it would obscure the view of these two supporting structures.

The louver 29 is shown as having a wide oval slot 71 through which the lift cord 41 passes. The length of the oval allows the lift cord 41 to work and freely pass through the louvers 29 regardless of the angular tilt orientation of the louvers 29. FIG. 3 also illustrates that in a resting position, the horizontal step connector 65 is on an even level with the interference member 45 just before actuation and while in the rest position.

In one embodiment, the interference member 45 is a crimped member. A crimped member may have an expanded portion to form an interference with respect to an aperture 73 which is seen extending vertically through the louver 29 and is just adjacent the wide oval slot 71. The location of the aperture 73 adjacent the wide oval slot 71 is a matter of design choice. Aperture 73 can exist to the other side of wide oval slot 71, and the left ladder cord set 25 can extend to either side of the lift cord 41, and to either side of the first selective lift cord 37.

Referring to FIG. 4, a view of the underside of the head rail 23 illustrates some of the organizational structure on the underside. A pair of ladder cord set slots 81 enable the left and right ladder cord sets 25 and 27 to pass through. The reasons for the relatively wide slot is to accommodate left and right ladder cord sets 25 and 27 which may be wider, and which may be tape sets instead of cord sets.

A pair of smooth slip fittings 83 has an aperture and accommodates the lift cords 41. A pair of smooth slip fittings 85 are typically made of a low friction material such as nylon and, along with other low friction fittings within the head rail 23, acts to make operation of the first selective lift cord 37, second selective lift cord 39 as frictionless as possible. Again, the orientation of the clip fittings 83 and 85 is a matter of design choice and they could assume any orientation, but the best orientation is preferably directly vertically over the position they will assume in the louvers 29.

Referring to FIG. 5 an upper view of the head rail 23 is illustrated and shows some further details of the routing of the first selective lift cord 37, second selective lift cord 39 and lift cord 41. A set of tilt actuator drums 91 are provided for attachment to the first vertical cord 61 and second vertical cord 63 of the left and right ladder cord sets 25 and 27.

Another way to provide horizontal lift pairing of the louvers 29 can take advantage of the fact that during the raising of the blinds where all louvers 29 are collected that the lift cord passes freely through the wide oval slot 71 in each louver 29. Only when the louvers are collected by being stacked upon the base louver 31, will each louver move up. In conventional blind sets, the wide oval slot 71 is so wide that all of the louvers in a conventional blind set will depend solely on either the base louver 31 during raising, or upon the left and right ladder cord sets 25 and 27. The differential lift given some of the louvers as was seen in FIGS. 1 and 2 involve movement against only the weight of the louvers, and only over a short distance.

If a louver had a limited dependence from the lift cords 41, it lift within the space of its left and right ladder cord sets 25 and 27 initially to form a pair, and then become later collected as a pair based upon further movement of the lift cords 41. The further simplification of the raising of some louvers based upon the lift cords 41 alone could be accomplished with a slip fitting which can be added to the wide oval slot 71. The slip fitting can be of any type. A slip fitting should give only enough resistance to movement of the lift cords 41 which is equivalent to that necessary to overcome the weight of half of the louver 29 to which it is attached, to permit it to be raised from its resting position against its lower horizontal step connector 65 and to raise it up to a position adjacent to the horizontal step connectors 65 of the next higher louver 29.

Referring to FIG. 6, a view of an insertable slip fitting 101 is shown in place with respect to a wide oval slot 71 seen in a louver 29. The details of the insertable slip fitting 101 can be widely varying, but the insertable slip fitting 101 should be able to be inserted on an assembled blind set with an existing lift cord 41 in place without having to dis-assemble the blind set or severing or disconnecting the cord 41.

In terms of geometry, the design should enable being opened and slipped around the lift cord 41 and then brought to a position in place with respect to the wide oval slot 71. The insertable slip fitting 101 should have an even width for accommodating the lift cord 41. It is most highly desirable that the insertable slip fitting 101 have a structural orientation that will not bind the wide oval slot 71 or cause a changed force or surface presented to the lift cord 41 when it is in place. Due consideration must be given to the relative friction between the materials employed for the lift cord 41 and insertable slip fitting 101. Depending upon overall wear, friction and other geometry requirements, the slip fitting 101 can be made of plastic, polyurethane, nylon, fiber glass, metal, glass, carbon composite, polypropylene, Teflon or a Teflon or other material coating of any of the aforementioned materials.

It is preferable that the insertable slip fitting 101 be secured to the louver 29 without lateral pressure. One method could involve an independent snap fitting or the like. Referring to FIG. 7, details of one embodiment of the slip fitting 101 includes an upper flange 103 which overlies a main vertical extending portion 105 shown in dashed line format. The insertable slip fitting 101 has an slot opening 107 which has a beveled entrance over part of its depth. The slot opening 107 leads into a matching oval (or round) main opening 109. The main opening 109 accommodates the lift cord 41.

The lift cord is shown as being slightly bigger than the inside surface of the lift cords 41 inside surface of the slip fitting 101 as it is expected that, depending upon the material and density of lift cord 41, that lift cord 41 will be somewhat compressed to obtain the correct resistance. The setting of the lateral clearance for the lift cord 41 within the insertable slip fitting 101 will depend upon a number of factors, including the materials used and the relative friction between them.

However, to begin with, an idealized frictional resistance should be computed. This is the amount of the vertical lifting force from all of the lift cords 41, against the insertable slip fittings 101 present on the blind set 21. This amount of force should be only infinitesimally greater than the weight of the louver 29 to be lifted (including the weights if any of the insertable slip fitting 101, and other components supported by the louver 29 to be lifted). Where a louver 29 is to be lifted from both ends with two insertable slip fitting 101, the force will be halved. An extra amount should be added to account for wear on the insertable slip fitting 101 from sliding use for a long period of time.

Only the act of using the lift cord to repeatedly and completely lift the blind set and louvers will cause any significant wear on the insertable slip fitting 101. Further, the insertable slip fitting 101 at the top of the louver set will experience the most wear for each lifting and lowering of the louvers 29 of the blind set 21.

On letting the louvers 29 of the blind set 21 down, the maximum pulling resistance experienced by the base louver 31 will occur as the lowermost louver 29 having an insertable slip fitting 101 attached rests into place on its left and right ladder cord sets 25 and 27. As the base louver then moves its last few inches away from the lowermost louver 29 having an insertable slip fitting 101 attached, the resistance against further movement of each of the lift cords 41 moving through all of its insertable slip fittings 101 will be at its maximum. Thus the weight of the base louver should be sufficient to overcome this resistance, which will be at least as high as the sum of all of the louvers 29 having an insertable slip fitting 101 attached.

To account for wear and any diminution in holding force due to repeated lowering and raising of the blind set 21, the insertable slip fittings 101 will have an initial resistance which is somewhat higher than the minimum necessary to overcome the weight of the louver and raise it. Once both the minimum value of resistance is known, and then once a factor of resistance is added in to combat wear over time, the selection of materials and dimensions is made to achieve the desired values.

The density, compressibility and wear characteristics of the lift cords 41 must be taken to account in selecting the materials of the insertable slip fitting 101, the surface area exposed to the left cords 41 and the width of the main opening 109, to name only some of the considerations which are materials based. A thicker louver gives the opportunity for a vertically extended length and greater vertical contribution to surface area for the main opening 109. Greater surface area means less wear and the ability to more widely distribute the wear over a greater surface area. Other factors include the shape of the inside surfaces of the main opening 109 and more.

Referring to FIG. 8, an end view looking into the end of the slot opening 107 reveals two small hook extensions 111 on the end adjacent the slot opening 107, and a snap projection 113 on the end opposite the slot opening 107. The two small hook extensions 111 are shown as having small projections toward the viewer while snap projection 113 has some projection away from the viewer and cannot be seen in FIG. 8.

Referring to FIG. 9, an expanded side view, rotated 90° from the view seen in FIG. 8 illustrates further details of the two small hook extensions 111 and snap projection 113. The snap projection 113 can be seen to have a dimple 115 or other projection to enable the slip fitting 101 to be inserted into the wide oval slot 71, either by a user or at the factory.

A typical installation will have the installer or user approach the louver 29 in much the same condition as it might be seen in FIG. 3 (probably excluding the first selective lift cord 37). The user than presses the end of the slip fitting 101 having the slot opening 107 toward the lift cord 41 with the flange 105 in the upward position, oriented away from the top surface of the louver 29 into which it is to be attached. If necessary, depending upon the relative sizes of the slip fitting 101 and lift cord 41 the user can manually assist the widening of the slot opening 107 to admit the lift cord 41.

Once the lift cord is admitted, the sides of the slip fitting 101 should snap shut to yield the configuration seen in FIG. 7. The user is then free to reorient the slip fitting 101 to a position where it will align with the wide oval slot 71. The user then directs the bottom end of the slip fitting 101 having the two small hook extensions 111 into and toward one end of the wide oval slot 71 so that the two small hook extensions 111 extend though the wide oval slot with pressure. Then, the user brings snap projection down and with snap resistance, through the other end of the wide oval slot 71 to cause the slip fitting 101 to securely snap into place with respect to the wide oval slot 71, to secure it with respect to the louver 29.

In the case of a home installation, the user attaches the slip fitting 101 only to the louvers desired to move to an upper position on the initial pull of the lift cord 41. Since pulling of the lift cord 41 will tend to raise the base louver 31 by an inch or two, an added length for the base louver 31 can be utilized, or in the alternative some arrangement to pull the lift cords down by 2 or so inches to make sure that the bottom most louvers 29 fitted with the slip fitting 101 (in the case where the louver just above the base louver is fitted) is all seated before lift is applied. Where the bottom louver 29 which is not the base louver is not fitted with the slip fitting 101, there should be enough downward movement of the lift cord in releasing the last louver 29 into its left and right ladder cord sets 25 and 27 to insure that all louvers fitted with the slip fitting 101 are properly seated.

While the present invention has been described in terms of a system and method for enabling creative manipulation of some louvers in a horizontal blind set, one skilled in the art will realize that the structure and techniques of the present invention can be applied to many structures, including any structure or technique where a shortened control movement is desired within a much larger control space.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A horizontal blind set comprising:

an upper support;

a ladder cord having a pair of vertical members and a series of horizontal step connectors, said ladder cord supported from said upper support;

a plurality of louvers supported by said ladder cord;

a lift cord supported from said upper support, for raising a bottom most one of said plurality of louvers upward to collect all said plurality of louvers in an upper position adjacent said upper support and closely adjacent each other;

a selective lift cord extending from said upper support and through a selective lift aperture in each of said plurality of louvers through which it extends; and at least one interference member supported by said selective lift cord and positioned underneath a selective lift aperture of at least one of said plurality of louvers having an selective lift aperture such that a raising of said lift cord toward said upper support causes a raising of said louver having said interference member positioned immediately underneath it, toward a next most adjacent overlying louver not having said at least one interference member and away from a next most adjacent underlying louver not having said at least one interference member such that the lifting of the least one of said plurality of louvers having an selective lift aperture with said interference member positioned immediately underneath it creates an increased spacing between said least one of said plurality of louvers having an selective lift aperture with said interference member positioned immediately underneath it and the next most adjacent underlying louver not having said at least one interference member, said increased spacing ranging from more than a single louver spacing to a nearly double louver spacing without affecting the angular orientation of said plurality of said louvers.

2. The horizontal blind set as recited in claim 1 wherein said upper support is a channel.

3. The horizontal blind set as recited in claim 1 wherein said at least one interference member has a size which will enable said at least one interference member to perform said raising of said louver as said selective lift cord is moved upward.

4. The horizontal blind set as recited in claim 3 wherein said at least one interference member is a metal member crimped onto said selective lift cord.

5. The horizontal blind set as recited in claim 3 wherein said at least one interference member is a member attached onto said selective lift cord.

6. The horizontal blind set as recited in claim 1 wherein said lift cord extending from said upper support and through a lift cord opening in each of said plurality of louvers through which it extends, and wherein said selective lift aperture and said lift cord opening are adjacent and centered along the length of at least one of said plurality of louvers.

7. A horizontal blind set comprising:

an upper support;

a ladder cord having a pair of vertical members and a series of horizontal step connectors, said ladder cord supported from said upper support;

a plurality of louvers supported by said ladder cord;

a lift cord for raising a bottom most one of said louvers upward to collect all said louvers in an upper position adjacent said upper support and closely adjacent each other;

a slip fitting attached to at least a first one of said plurality of louvers between at least a second one of said plurality of louvers overlying said first one of said plurality of said louvers lacking said slip fitting and at least a third one of said plurality of louvers underlying said first one of said plurality of said louvers lacking said slip fitting, said slip fitting engaging said lift cord with enough force between said lift cord and said slip fitting to lift said at least said first one of said plurality of louvers with respect to said lift cord toward said second one of said plurality of louvers overlying said first one of said plurality of said louvers, but not enough force engagement with said lift cord to resist movement of said lift cord with respect to said slip fitting once said at least a first one of said plurality of louvers is restrained by said at least a second one of said plurality of louvers overlying said at least a first one of said plurality of said louvers to then allow the lift cord to slip through said slip fitting to lift said plurality of said louvers into a position closely adjacent each others whereby the actuation of said lift cord by a distance approximating the distance between said first one of said plurality of louvers and said at least a second one of said plurality of louvers overlying said first one of said plurality of said louvers will cause a separation between said first one of said plurality of louvers and at least a third one of said plurality of louvers underlying said first one of said plurality of said louvers, said increased separation ranging from more than a single louver spacing to a nearly double louver spacing without affecting the angular orientation of said plurality of said louvers.

8. The horizontal blind set as recited in claim 7 wherein said plurality of louvers supported by said ladder cord each have a lift cord opening and wherein said slip fitting is attached to every other said lift cord opening.

9. The horizontal blind set as recited in claim 8 wherein said slip fitting further comprises an upper flange attached to said slip fitting body to fix said body with respect to said lift cord opening.

10. The horizontal blind set as recited in claim 9 wherein said slip fitting further comprises an extension opposite said flange for securing said slip fitting with respect to said lift cord opening.

11. The horizontal blind set as recited in claim 8 wherein said slip fitting further comprises a body having an main opening and a slot opening for admitting said lift cord to pass through said main opening, said main opening having at least one surface for engaging said lift cord with said enough force between said lift cord and said slip fitting to lift said at least one of said plurality of louvers with respect to said lift cord, but not enough to resist movement of said lift cord with respect to said slip fitting once said at least one of said plurality of louvers is restrained by at least one of another one of said at least one of said plurality of louvers and said ladder cord.

* * * * *